United States Patent [19]

Spector et al.

[11] Patent Number: 4,722,401

[45] Date of Patent: Feb. 2, 1988

[54] ACTUATION CIRCUITRY FOR EMERGENCY ENERGIZATION OF VEHICLE FIRE AND EXPLOSION DETECTION AND SUPPRESSION SYSTEM WHEN VEHICLE IS NOT IN OPERATION

[75] Inventors: Yehiel Spector, Tel Aviv; Ilan Cohen, Petach Tikva, both of Israel

[73] Assignee: Spectronix Ltd., Tel Aviv, Israel

[21] Appl. No.: 894,499

[22] Filed: Aug. 4, 1986

Related U.S. Application Data

[63] Continuation of Ser. No. 738,496, May 28, 1985, abandoned, which is a continuation of Ser. No. 488,765, Apr. 26, 1983, abandoned.

[30] Foreign Application Priority Data

May 27, 1982 [IL] Israel ..... 65907

[51] Int. Cl.[4] ..... A62C 37/18

[52] U.S. Cl. ..... 169/61; 169/62

[58] Field of Search ..... 169/61, 62

[56] References Cited

U.S. PATENT DOCUMENTS 3,156,908 11/1964 Kopan et al. ..... 169/61 X
3,688,846 9/1972 Lease ..... 169/62 X
3,993,138 11/1976 Stevens et al. ..... 169/62 X
4,270,613 6/1981 Spector et al. ..... 169/62 X

FOREIGN PATENT DOCUMENTS 1455755 11/1976 United Kingdom .
1473401 5/1977 United Kingdom .
2022409 12/1979 United Kingdom .
1558915 1/1980 United Kingdom .

*Primary Examiner*—Andres Kashnikow
*Assistant Examiner*—Kevin Patrick Weldon
*Attorney, Agent, or Firm*—Browdy and Neimark

[57] ABSTRACT

Actuation circuitry causes emergency energization of a vehicle fire and explosion detection and suppression system when the vehicle is not in operation. The actuation circuitry includes a simple fire and/or explosion detector which draws a small amount of power relative to that required by the main fire and explosion detection and suppression system when operative. When the detector detects an event which may be a fire or explosion the actuation circuitry activates the main system which analyzes the event by its more sophisticated circuitry and acts accordingly. When such event is no longer detected by the detector of the actuation circuitry, the main system is shut down.

12 Claims, 3 Drawing Figures

ACTUATION CIRCUITRY FOR EMERGENCY ENERGIZATION OF VEHICLE FIRE AND EXPLOSION DETECTION AND SUPPRESSION SYSTEM WHEN VEHICLE IS NOT IN OPERATION

CROSS REFERENCE TO RELATED APPLICATIONS

This application is a continuation of prior application Ser. No. 06/738,496, filed May 28, 1985, now abandoned, which in turn was a continuation of prior application Ser. No. 06/488,765, filed on Apr. 26, 1983, now abandoned.

FIELD OF THE INVENTION

The present invention relates to fire and explosion detection and suppression apparatus generally and, more particularly, to fire and explosion detection and suppression apparatus for vehicles.

BACKGROUND OF THE INVENTION

The patent literature contains descriptions of a number of fire and explosion detection and suppression systems for vehicles, such as armoured vehicles. A particularly effective system is described in U.S. Pat. No. 4,270,613 of the present assignee.

Conventional fire and explosion detection and suppression systems of the general type described in U.S. Pat. No. 4,270,613 are normally operative to protect a vehicle when it is in operation. A number of modes of operation, such as a combat mode and a peace mode, may be provided to match the type of response to the operational environment of the vehicle.

No protection is currently provided by systems of the type describe above when the vehicle is not in operation and is, for example, in long term storage in an emergency warehouse.

It is known that significant vehicle damage has occurred to stored vehicles due to fire and explosions due to the leaking of fuel and the accumulation of fuel and explosive vapors as well as other causes.

SUMMARY OF THE INVENTION

The present invention seeks to provide actuation circuitry for emergency energization of vehicle fire and explosion detection and suppression systems when the vehicle is not in operation, thereby to overcome the acknowledged need to prevent damage to vehicles from fires and explosions.

There is thus provided, in accordance with an embodiment of the present invention actuation circuitry for emergency energization of vehicle fire and explosion detection and suppression systems when a vehicle is not in operation, comprising a stand-by detector, hold circuitry actuated by the stand-by detector, and driver circuitry actuated by the hold circuitry for causing energization of a vehicle fire and explosion detection and suppression system in response to sensed fire detection by the stand-by detector.

Further in accordance with an embodiment of the present invention, electrical power for the emergency energization actuation circuitry is provided by the vehicle battery. Alternatively, a battery may be incorporated in the emergency energization actuation circuitry.

Additionally, in accordance with an embodiment of the present invention, there is provided a vehicle fire and explosion detection and suppression actuation circuitry system operative in response to an energization input, a stand-by detector operative when the vehicle is not in operation to sense the presence of fire or explosion related events, hold circuitry actuated in response to a detection output of the stand-by detector, and driver circuitry actuated by the hold circuitry for providing the energization input to the fire and explosion detection and suppression system.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1:
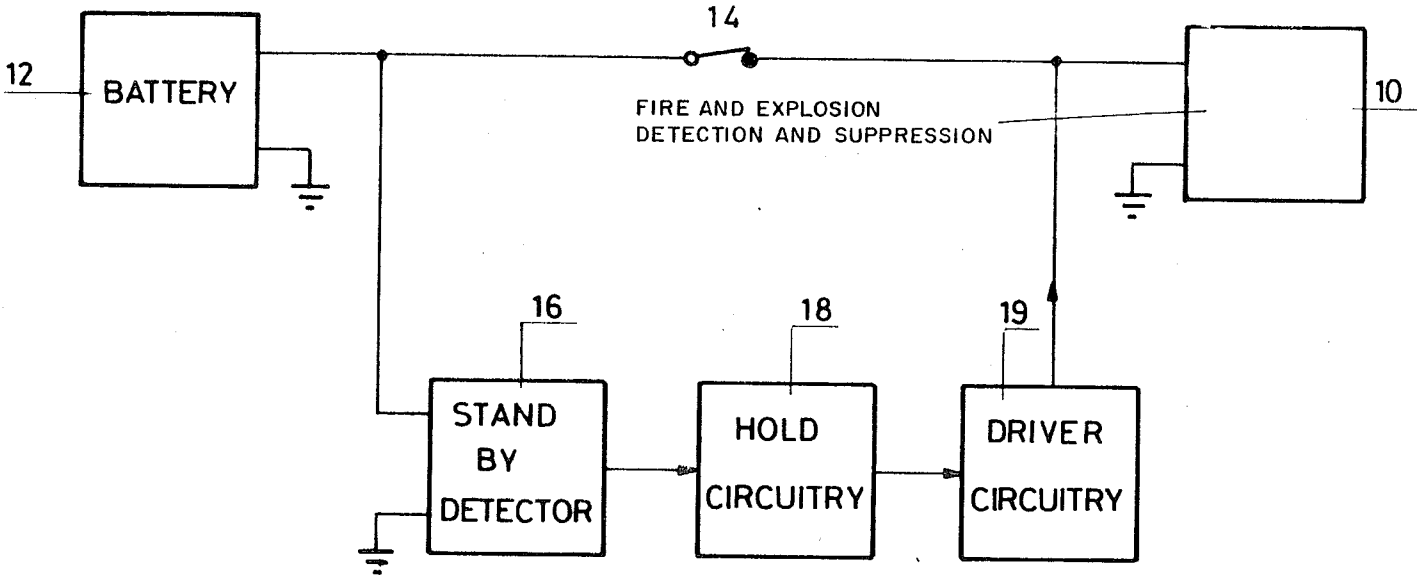
FIG. 1 is a block diagram illustration of fire and/or explosion protection apparatus constructed and operative in accordance with a preferred embodiment of the present invention.

Reference is now made to FIG. 1, which illustrates fire and/or explosion protection apparatus constructed and operative in accordance with a preferred embodiment of the present invention, and comprising a fire and explosion detection and suppression system 10 of conventional construction and which is preferably embodied in a fire and explosion detection and suppression system of the type described in assignee's U.S. Pat. No. 4,270,613, the disclosure of which is incorporated herein by reference.

Fire and explosion detection and suppression system 10 is coupled to a source of electrical power 12, such as a vehicle battery, via a switch 14, which switch normally permits operation of the automatic fire and explosion detection and suppression system associated therewith and disclosed in U.S. Pat. No. 4,270,613. When the vehicle is not in operation, switch 14 may be considered to be open.

A stand-by detector 16 is coupled to electrical power source 12, or alternatively to an internal battery which is separate from the vehicle battery, and is operative to detect events associated with a fire and/or an explosion. Preferably, detector 16 is an IR sensor which draws a very small amount of power from the power source 12. Alternatively, any other suitable stand-by detector, such as a heat sensor, may be employed.

The stand-by detector 16 outputs to hold circuitry 18 which converts a relatively short duration output of the detector 16 to a longer duration output which is in turn supplied to driver circuitry 19 Driver circuitry 19, which typically comprises a transistor, is operative to provide a supply voltage to fire and explosion detection and suppression system 10 for causing energization thereof in response to detection by detector 16.

Figure 2:
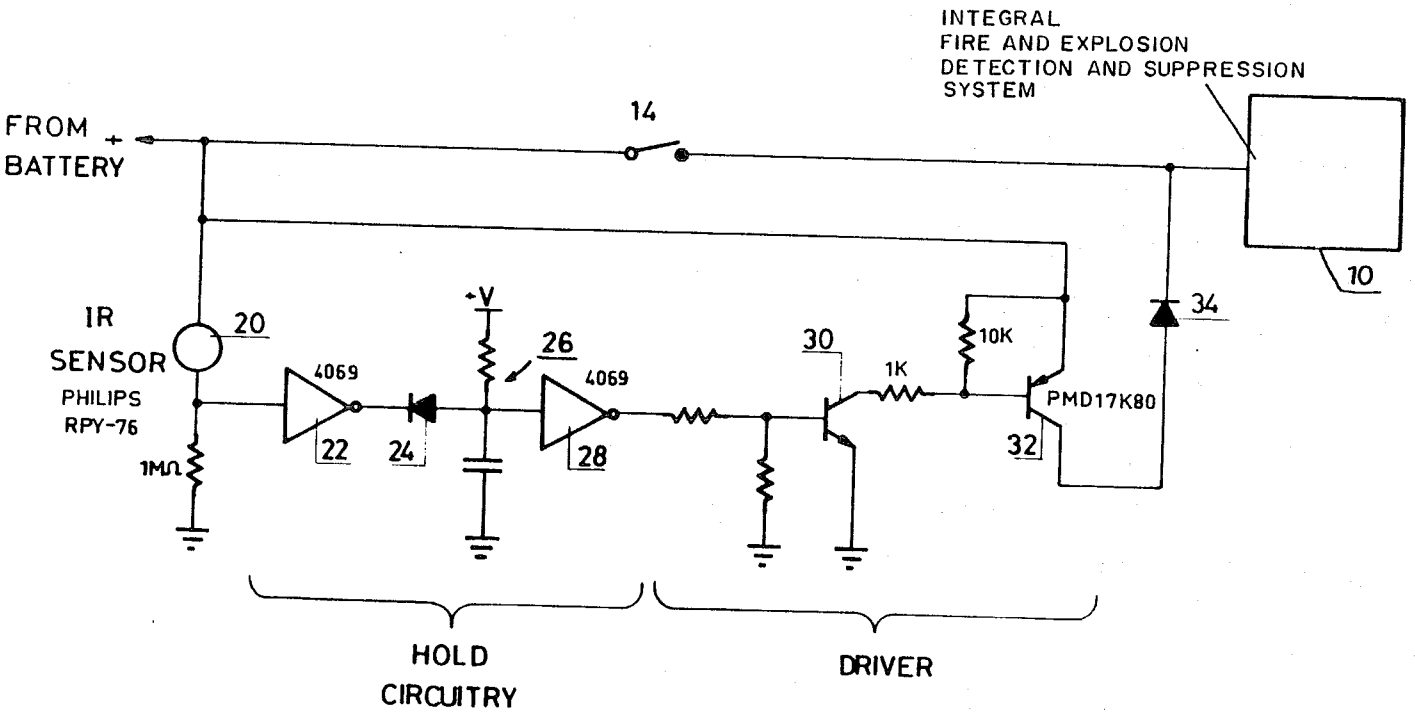
FIG. 2 is a schematic diagram of the actuation circuitry in the apparatus of FIG. 1.

Reference is now made to FIG. 2, which is an electrical schematic illustration of the actuation circuitry of FIG. 1. It is seen that the IR sensor 20 which embodies the detector 16 outputs to hold circuitry 18, which incorporates an inverter 22, a diode 24 and an RC combination 26 as well as an inverter 28. Inverter 28 is coupled to driver circuitry 19 which includes a pair of transistors 30 and 32 connected in a Danlington configuration. The collector of transistor 32 is coupled via a diode 34 to the enable input of fire and explosion detection and suppression system 10.

Figure 3:
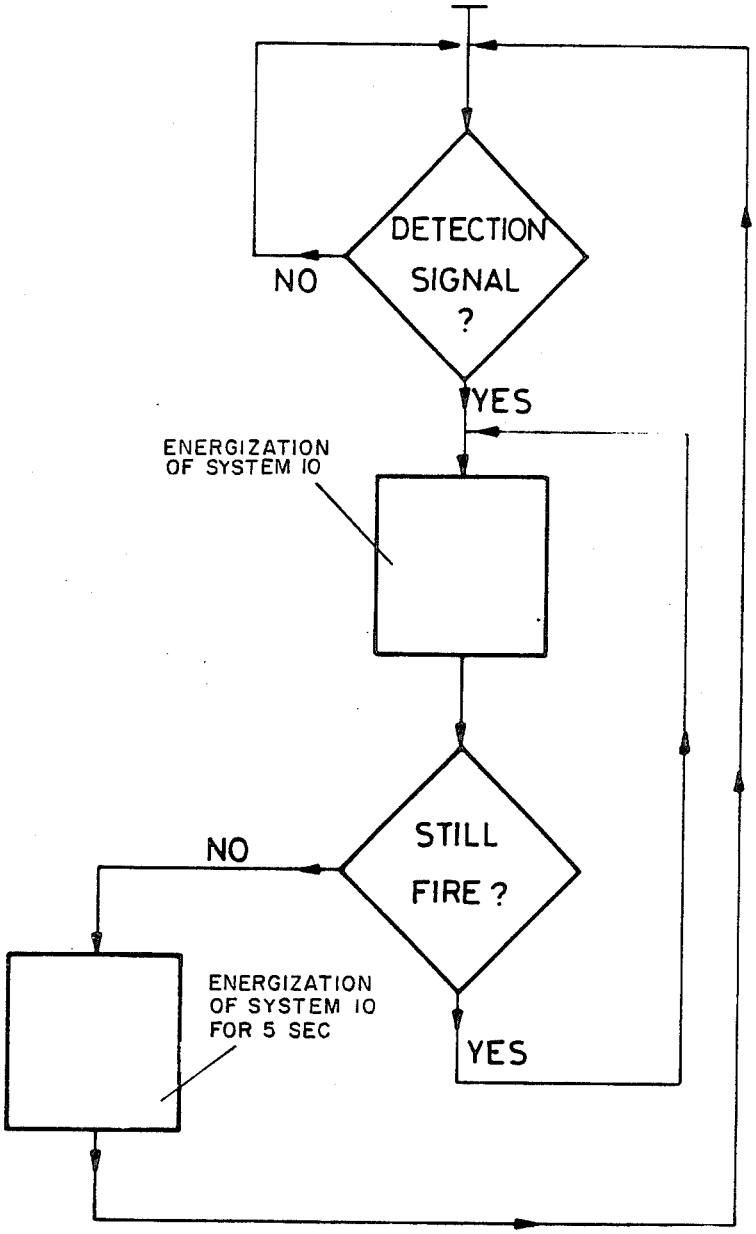
FIG. 3 is a logic diagram illustration of the operation of the actuation circuitry of FIGS. 1 and 2.

Reference is now made to FIG. 3 which is a logic diagram illustration of the operation of the actuation circuitry of FIGS. 1 and 2. The system of the invention, which is operative continuously whether or not the vehicle is in operation, or alternatively just when the vehicle is not in operation, continually seeks to detect at detector 16, a fire or explosion related event. Upon detection by detector 16, energization of the fire and explosion detection and suppression system 10 is initiated. Following initiation of operation of the fire and explosion detection and suppression system 10, the output of detector 16 determines whether fire and explosion detection and suppression system energization is to continue. Once detector 16 fails to detect fire, the energization of the fire and explosion detection and suppression system is terminated, typically after five seconds, and the system continues in its stand-by operation mode. So long as fire continues to be detected, energization of the fire and explosion detection and suppression system continues.

It will be appreciated by persons skilled in the art that the present invention is not limited to what has been particularly shown and described hereinabove. In particular, it should be appreciated that any suitable fire and explosion detection and suppression system may be employed. The scope of the present invention is defined only by the claims which follow.

What is claimed is:

1. In a vehicle fire and explosion detection and suppression system including fire and explosion detection and suppression means, said means being operative when the vehicle is in operation, the improvement whereby the vehicle fire and explosion detection and suppression system includes a stand-by mode permitting energization of said vehicle fire and explosion detection and suppression means when an event associated with fire and/or explosion is detected, comprising:

stand-by actuation circuitry means for detecting an event associated with a fire and/or an explosion and for causing said fire and explosion detection and suppression means to be energized when said event is detected, said stand-by actuation circuitry means drawing a small amount of power relative to that required by said fire and explosion detection and suppression means when operative.

2. A vehicle fire and explosion detection and suppression system in accordance with claim 1, wherein said stand-by actuation circuitry means comprises:

stand-by detector means for detecting an event associated with a fire and/or an explosion and providing an output signal when such an event is detected; and energization means, connected to said stand-by detector means for providing a supply voltage sufficient to energize said fire and explosion detection and suppression means when said output signal is received from said stand-by detector means.

3. A fire and explosion detection and suppression system in accordance with claim 2, wherein said energization means comprises:

hold circuitry connected to said stand-by detector means, for converting any output signal received from said stand-by detector means to a longer duration output; and driver circuitry, connected to said hold circuitry, for converting said longer duration output provided by said hold circuitry to a voltage sufficient to energize said fire and explosion detection and suppression means.

4. A fire and explosion detection and suppression system in accordance with claim 1, further including electrical power supply means for supplying power to said stand-by actuation circuitry means.

5. A fire and explosion detection and suppression system in accordance with claim 4, wherein said electrical power supply means comprises the vehicle battery.

6. A fire and explosion detection and suppression system in accordance with claim 4, wherein said electrical power supply means comprises a battery dedicated to said stand-by actuation circuitry means.

7. Actuation circuitry for the emergency energization of a vehicle fire and explosion detection and suppression system when the vehicle and the system are not in operation, comprising:

stand-by actuation circuitry means for detecting an event associated with a fire and/or an explosion and for causing a signal of sufficient voltage to be supplied to the vehicle fire and explosion detection and suppression system to energize and actuate said system when said event is detected, said stand-by actuation circuitry means drawing a small amount of power relative to that required by said fire and explosion detection and suppression system when operative.

8. Actuation circuitry in accordance with claim 7, wherein said stand-by actuation circuitry means comprises:

stand-by detector means for detecting an event associated with a fire and/or an explosion and providing an output signal when such an event is detected; and energization means, connected to said stand-by detector means for providing a supply voltage sufficient to actuate and energize said fire and explosion detection and suppression system when said output signal is received from said stand-by detector means.

9. Actuation circuitry in accordance with claim 8, wherein said energization means comprises:

hold circuitry connected to said stand-by detector means, for converting any output signal received from said stand-by detector means to a longer duration output; and driver circuitry, connected to said hold circuitry, for converting said longer duration output provided by said hold circuitry to a voltage sufficient to energize said fire and explosion detection and suppression system.

10. Actuation circuitry in accordance with claim 7, further including electrical power supply means for supplying power to said stand-by actuation circuitry means.

11. Actuation circuitry in accordance with claim 10, wherein said electrical power supply means comprises the vehicle battery.

12. Actuation circuitry in accordance with claim 6, wherein said electrical power supply means comprises a battery dedicated to said stand-by actuation circuitry means.

* * * * *